United States Patent [19]

Hirano et al.

[11] 4,374,923

[45] Feb. 22, 1983

[54] DIRECT POSITIVE SILVER HALIDE PHOTOGRAPHIC LIGHT-SENSITIVE MATERIAL

[75] Inventors: Shigeo Hirano; Tadao Sugimoto; Nobuyuki Tsujino, all of Minami-ashigara, Japan

[73] Assignee: Fuji Photo Film Co., Ltd., Kanagawa, Japan

[21] Appl. No.: 322,137

[22] Filed: Nov. 17, 1981

[30] Foreign Application Priority Data

Nov. 19, 1980 [JP] Japan ..... 55-162967

[51] Int. Cl.[3] ..... G03C 1/36

[52] U.S. Cl. ..... 430/410; 430/548; 430/547; 430/559; 430/542; 430/562; 430/217; 430/223

[58] Field of Search ..... 430/598, 410, 547, 559, 430/542, 562, 217, 223

[56] References Cited

U.S. PATENT DOCUMENTS

| | | | |
|---|---|---|---|
| 3,227,552 | 1/1966 | Whitmore | 430/226 |
| 4,030,925 | 6/1977 | Leone et al. | 430/598 |
| 4,323,643 | 4/1982 | Mifune et al. | 430/598 |

*Primary Examiner*—Won H. Louie, Jr.
*Attorney, Agent, or Firm*—Sughrue, Mion, Zinn, Macpeak and Seas

[57] ABSTRACT

A direct positive silver halide photographic light-sensitive material is described comprising a support having coated thereon at least one light-sensitive silver halide photographic emulsion layer, wherein at least one layer of the light-sensitive silver halide photographic emulsion layers and other hydrophilic colloid layers contains a compound represented by formula (I)

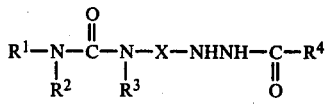

(I)

wherein $R^1$ and $R^2$ can each represent a hydrogen atom, an aliphatic group, an aromatic group, or a heterocyclic group; $R^3$ represents a hydrogen atom or an aliphatic group; $R^4$ represents a hydrogen atom, an aliphatic group, or an aromatic group; and X represents a divalent aromatic group.

The direct positive silver halide photographic light-sensitive material containing the above novel fogging agent compound has good preservability and provides excellent reversal photographic images in spite of changes (1) in the bromine ion concentration in a developing solution used for processing, (2) in the particle size of the internal latent image type silver halide grains, and (3) in the amount of the fogging agent employed.

26 Claims, No Drawings

DIRECT POSITIVE SILVER HALIDE PHOTOGRAPHIC LIGHT-SENSITIVE MATERIAL

FIELD OF THE INVENTION

The present invention relates to a silver halide photographic light-sensitive material by which direct positive photographic images are formed, and, more particularly, to a photographic light-sensitive material wherein a photographic emulsion layer or other hydrophilic colloid layer contains a novel compound as a fogging agent.

BACKGROUND OF THE INVENTION

In the field of silver halide photography, a technique in which positive photographic images are obtained without using a negative image intermediate, or an intermediate process producing a negative image, is called direct positive photography, and photographic light-sensitive materials and photographic emulsions using such a photographic technique are called direct positive light-sensitive photographic materials and direct positive photographic emulsions, respectively.

A variety of direct positive photographic techniques are known. The most useful methods are methods in which silver halide grains which have previously been fogged are exposed to light in the presence of a desensitizer followed by development, and methods comprising exposing a silver halide emulsion containing silver halide grains having light-sensitive specks mainly inside the silver halide grains to light and then developing the exposed emulsion in the presence of a fogging agent. The present invention relates to the latter technique. Silver halide emulsions possessing light-sensitive specks in the inside of the silver halide grains and forming latent images mainly inside the grains are referred to as internal latent image type silver halide emulsions, and thus are distinguished from silver halide grains which form latent images mainly on the surface of the grains.

Methods for obtaining direct positive images by surface-developing an internal latent image type silver halide photographic emulsion in the presence of a fogging agent, and photographic emulsions and photographic light-sensitive materials employed in such methods are disclosed in U.S. Pat. Nos. 2,456,953, 2,497,875, 2,497,876, 2,588,982, 2,592,250, 2,675,318, 3,227,552 and 3,761,276, British Pat. Nos. 1,011,062 and 1,151,363, Japanese Patent Publication No. 29405/68, etc.

In the internal latent image type method for obtaining direct positive images, the fogging agent can be incorporated into a developing solution. However, by incorporating the fogging agent into the photographic emulsion layers or associated layers of the photographic light-sensitive material, thereby absorbing the fogging agent onto the surface of the silver halide grains, better reversal characteristics can be obtained.

Fogging agents which can be employed in the above-described method for obtaining direct positive image include hydrazine and derivatives thereof as described in U.S. Pat. Nos. 2,563,785, 2,588,982 and 3,227,552, respectively. In particular, U.S. Pat. No. 3,227,552 discloses that hydrazide and hydrazine type compounds which are derivatives of hydrazine can be incorporated not only in the developing solution, but also in the light-sensitive layers. Also, fogging agents comprising heterocyclic quaternary salt compounds described in U.S. Pat. Nos. 3,615,615, 3,719,494, 3,734,738 and 3,759,901, Japanese Patent Application (OPI) Nos. 3426/77 and 69613/77 have been known.

Further, it has been proposed in U.S. Pat. No. 4,030,925 (corresponding to German Patent Application (OLS) No. 2,635,316) and U.S. Pat. No. 4,031,127 (corresponding to German Patent Application (OLS) No. 2,635,317) that acyl hydrazinophenylthiourea compounds be employed.

However, these known fogging agents are accompanied by several disadvantages, viz., they have an adverse influence on preservability of the direct positive photographic light-sensitive materials, they are deficient in fogging ability for internal latent image type silver halide grains having small particle size, their reversal characteristics vary greatly depending upon changes in bromine ion concentration in the developing solution used, and their reversal characteristics vary widely depending upon changes in the amount thereof used.

SUMMARY OF THE INVENTION

Therefore, an object of the present invention is to provide a direct positive photographic light-sensitive material having a good preservability.

Another object of the present invention is to provide a direct positive photographic light-sensitive material which provides reversal characteristics which do not substantially change upon changes in the bromine ion concentration of a developing solution used for development processing.

A further object of the present invention is to provide a direct positive photographic light-sensitive material which provides excellent reversal photographic images independently of the particle size of the internal latent image type silver halide grains used.

A still further object of the present invention is to provide a direct positive photographic light-sensitive material in which the variation of reversal characteristics due to changes in an amount of fogging agent added is small.

Other objects of the present invention will become apparent from the following detailed description and examples.

The above described objects of the present invention are achieved by incorporating a fogging agent represented by formula (I), as set forth below, into at least one hydrophilic colloid layer in a silver halide photographic light-sensitive material, preferably into an internal latent image type silver halide photographic emulsion layer or an adjacent hydrophilic colloid layer:

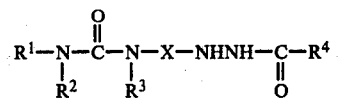

(I)

In formula (I), $R^1$ and $R^2$ (which may be the same or different) can each represent a hydrogen atom, an aliphatic group, an aromatic group, or a heterocyclic group; $R^3$ represents a hydrogen atom or an aliphatic group; $R^4$ represents a hydrogen atom, an aliphatic group or an aromatic group; and X represents a divalent aromatic group.

DETAILED DESCRIPTION OF THE INVENTION

The compounds represented by formula (I) are more particularly explained below.

The aliphatic groups represented by $R^1$, $R^2$, and $R^4$ of formula (I) includes a straight chain or branched chain alkyl group, a cycloalkyl group, including those having substituents, an alkenyl group, and an alkynyl group. Examples of the straight chain or branched chain alkyl groups for $R^1$ and $R^2$ include alkyl groups having from 1 to 18, and preferably from 1 to 8, carbon atoms. Specific examples include a methy group, an ethyl group, an isobutyl group, a t-octyl group, etc. Preferred examples of the straight chain or branched chain alkyl group for $R^4$ include alkyl groups having from 1 to 10 carbon atoms. Specific examples include a methyl group, an ethyl group, a propyl group, etc.

Examples of the cycloalkyl groups for $R^1$, $R^2$, and $R^4$ include cycloalkyl groups each having from 3 to 10 carbon atoms. Specific examples include a cyclopropyl group, a cyclohexyl group, an adamantyl group, etc.

Examples of the substituents for the alkyl group or the cycloalkyl group include an alkoxy group (e.g., a methoxy group, an ethoxy group, a propoxy group, a butoxy group, etc.), an alkoxycarbonyl group, a carbamoyl group, a hydroxy group, an alkylthio group, an amido group, an acyloxy group, a cyano group, a sulfonyl group, a halogen atom (e.g., a chlorine atom, a bromine atom, a fluorine atom, an iodine atom, etc.), an aryl group (e.g., a phenyl group, a halogen-substituted phenyl group, an alkyl-substituted phenyl group, etc.), etc. Specific examples of substituted alkyl groups and substituted cycloalkyl groups include a 3-methoxypropyl group, an ethoxycarbonylmethyl group, a 4-chlorocyclohexyl group, a benzyl group, a p-methylbenzyl group, a p-chlorobenzyl group, etc.

Examples of the alkenyl group include an allyl group, etc., and examples of the alkynyl group include a propargyl group, etc.

On the other hand, examples of the aromatic groups represented by $R^1$, $R^2$ and $R^4$ include a phenyl group, a naphthyl group, including those having substituents (e.g., an alkyl group, an alkoxy group, an acylhydrazino group, a dialkylamino group, an alkoxycarbonyl group, a cyano group, a carboxy group, a nitro group, an alkylthio group, a hydroxy group, a sulfonyl group, a carbamoyl group, a halogen atom, an acylamino group, a sulfonamido group, a thiourea group, etc.). Specific examples of the substituted groups include, for example, a p-methoxyphenyl group, an o-methoxyphenyl group, a tolyl group, a p-formylhydrazinophenyl group, a p-chlorophenyl group, an m-fluorophenyl group, an m-benzamidophenyl group, an m-acetamidophenyl group, an m-benzenesulfonamidophenyl group, an m-phenylthioureidophenyl group, etc.

The heterocyclic groups represented by $R^1$ and $R^2$ include a 5-membered or 6-membered single ring, or a condensed ring, having at least one hetero atom selected from oxygen, nitrogen, sulfur, and selenium atoms, and these heterocyclic groups may have substituents. Specific examples of the heterocyclic groups include a pyrroline ring, a pyridine ring, a quinoline ring, an indole ring, an oxazole ring, a benzoxazole ring, a naphthoxazole ring, an imidazole ring, a benzimidazole ring, a thiazoline ring, a thiazole ring, a benzothiazole ring, a naphthothiazole ring, a selenazole ring, a benzoselenazole ring, a naphthoselenazole ring, etc.

These heterocyclic ring groups may be substituted by an alkyl group having from 1 to 4 carbon atoms, such as a methyl group, an ethyl group, etc.; an alkoxy group having from 1 to 4 carbon atoms, such as a methoxy group, an ethoxy group, etc.; an aryl group having from 6 to 18 carbon atoms, such as a phenyl group, etc.; a halogen atom such as a chlorine atom, a bromine atom, etc.; an alkoxycarbonyl group, a cyano group, an amido group, etc.

It is preferred that one of $R^1$ and $R^2$ be a hydrogen atom. It is also preferred that $R^4$ be a hydrogen atom or a methyl group, and particularly a hydrogen atom.

The aliphatic groups represented by $R^3$ include a straight chain or branched chain alkyl group, a cycloalkyl group, including those having substituents, an alkenyl group, and an alkynyl group. The straight chain or branched chain alkyl group is generally an alkyl group having from 1 to 18 carbon atms, and preferably from 1 to 6 carbon atoms, and specific examples thereof include a methyl group, an ethyl group, an isopropyl group, etc. The cycloalkyl group is generally an cycloalkyl group having from 3 to 10 carbon atoms, and specific examples thereof include a cyclopentyl group, a cyclohexyl group, etc. Examples of the substituent include an alkoxy group (e.g., a methoxy group, an ethoxy group, etc.), an alkoxycarbonyl group, an aryl group (e.g., a phenyl group, a halogen-substituted phenyl group, an alkoxyphenyl group, an alkylphenyl group, etc.), an amido group, an acyloxy group, etc. Specific examples of such substituted groups include a 3-methoxypropyl group, a benzyl group, a p-chlorobenzyl group, a p-methoxybenzyl group, a p-methylbenzyl group, etc. Examples of the alkenyl group include alkenyl groups having from 3 to 12 carbon atoms, and preferably, for example, an allyl group, a 2-butenyl group, etc.

$R^3$ is preferably a hydrogen atom.

X represents a divalent aromatic group and specific examples thereof include, for example, a phenylene group, a naphthylene group (e.g., a 1,2-naphthylene group, a 1,4-naphthylene group, a 2,3-naphthylene group, a 1,5-naphthylene group, and a 1,8-naphthylene group), and substituted groups thereof.

Examples of the substituents for the divalent aromatic groups include, for example, an alkyl group having from 1 to 20 carbon atoms (which may be branched), an aralkyl group the alkyl moiety of which has from 1 to 3 carbon atoms, an alkoxy group (having preferably from 1 to 20 carbon atoms), a substituted alkoxy group (preferably having from 1 to 20 carbon atoms), a mono- or di-substituted amino group substituted with one or two alkyl groups or substituted alkyl groups (each having from 1 to 20 carbon atoms), an aliphatic acylamino group (having preferably from 2 to 21 carbon atoms), an aromatic acylamino group, an alkylthio group, a hydroxy group, a halogen atom (e.g., a chlorine atom, etc.), and so forth.

X is preferably a phenylene group.

Preferred compounds among the compounds represented by the general formula (I) are those represented by formula (II)

$$R^1-NH\overset{\overset{\displaystyle O}{\|}}{C}NH-X-NHNHCHO \qquad \text{(II)}$$

wherein $R^1$ and X have the same meanings as defined in formula (I) above.

Specific examples of the fogging agents according to the present invention are set forth below.

1. 1-Formyl-2-[4-(3-phenylureido)phenyl]hydrazine
2. 2-{4-[3-(4-Chlorophenyl)ureido]phenyl}-1-formylhydrazine
3. 2-{4-[3-(2-Chlorophenyl)ureido]phenyl}-1-formylhydrazine
4. 1-Formyl-2-{4-[3-(4-methoxyphenyl)ureido]phenyl}-hydrazine
5. 1-Formyl-2-{2-methoxy-4-[3-(4-methylphenyl-)ureido]phenyl}-hydrazine
6. 1-Formyl-2-{4-[3-(2-methoxyphenyl)ureido]phenyl}-hydrazine
7. 2-{4-[3-(3-Acetamidophenyl)ureido]phenyl}-1-formylhydrazine
8. 1-Formyl-2-[3-(3-phenylureido)phenyl]hydrazine
9. 1-Formyl-2-[4-(3-methylureido)phenyl]hydrazine
10. 2-[4-(3-Ethylureido)phenyl]-1-formylhydrazine
11. 1-Formyl-2-[4-(3-propylureido)phenyl]hydrazine
12. 2-[4-(3-Butylureido)phenyl]-1-formylhydrazine
13. 2-[4-(3-t-Butylureido)phenyl]-1-formylhydrazine
14. 1-Formyl-2-[4-(3-pentylureido)phenyl]hydrazine
15. 2-[4-(3-Dodecylureido)phenyl]-1-formylhydrazine
16. 1-Formyl-2-[4-(3-octadecylureido)phenyl]hydrazine
17. 2-[4-(3-Cyclohexylureido)phenyl]-1-formylhydrazine
18. 2-[4-(3-Benzylureido)phenyl]-1-formylhydrazine
19. 2-[4-(3-Allylureido)phenyl]-1-formylhydrazine
20. 2-[4-(3-Ethoxycarbonylmethylureido)phenyl]-1-formylhydrazine
21. 1-Formyl-2-{4-[3-(2-pyridyl)ureido]phenyl}hydrazine
22. 1-Formyl-2-{4-[3-(2-thienyl)ureido]phenyl}hydrazine
23. 2-[4-{3-[3-(2,4-di-t-Amylphenoxyacetamido)phenyl-]ureido}phenyl]-1-formylhydrazine
24. 2-{4-[3-(2-Benzothiazolyl)ureido]phenyl}-1-formylhydrazine
25. 1-Formyl-2-{4-[3-(4-methylthiazol-2-yl)ureido]-phenyl}hydrazine
26. 2-{4-[3-(3-Benzamidophenyl)ureido]phenyl}-1-formylhydrazine
27. 2-{4-[3-(3-Benzenesulfonamidophenyl)ureido]-phenyl}-1-formylhydrazine
28. 1-Formyl-2-{4-[3-(3-nitrophenyl)ureido[phenyl}hydrazine
29. 1-Formyl-2-[4-{3-[3-(3-phenylthioureido)phenyl-]ureido}phenyl]hydrazine
30. 1-Acetyl-2-[4-(3-phenylureido)phenyl]hydrazine
31. 1-Benzoyl-2-[4-(3-phenylureido)phenyl]hydrazine
32. 1(4-Chlorobenzoyl)-2-[2-methyl-4-(3-phenylureido)-phenyl]hydrazine
33. 1-Cyclohexylcarbonyl-2-[4-(3-phenylureido)-phenyl]hydrazine
34. 1-Formyl-2-{4-[3-(4-methylphenyl)ureido]phenyl}-hydrazine The compounds of the general formula (I) used in the present invention can be synthesized by the following general method:

First, 4- or 3-nitrophenylhydrazine is reacted with formic acid or a corresponding acid anhydride or acid chloride, and the corresponding 2-(4- or 3-nitrophenyl)-1-formylhydrazine is obtained. These nitrophenylhydrazines can be easily converted into corresponding amino compounds by catalytically reducing them in a solvent such as an alcohol (e.g., ethanol, methyl Cellosolve, etc.) or dioxane using palladium-carbon as a catalyst, or heating them together with reduced iron in an alcohol. By reacting the amino compounds thus-obtained and various isocyanates or precursors thereof in an aprotic polar solvent, such as dimethylformamide, acetonitrile, tetrahydrofuran, dioxane, etc., desired compounds according to formula (I) can be prepared.

Synthesis methods for the raw materials for producing the compounds according to the present invention and for producing the compounds per se are more particularly described below:

I. Synthesis of Raw Materials

(I) 2-(4-Nitrophenyl)-1-formylhydrazine 459 g of 4-nitrophenylhydrazine was added to 1.6 liters of acetonitrile, and then 322 g of formic acid was gradually added to form a homogeneous solution, and, after 20 minutes, crystals formed. After allowing the reaction to proceed for 2 hours at 80° C. of temperature in a reaction vessel, the reaction system was cooled and the crystals formed were recovered by filtration, washed with acetonitrile, and dried, to provide 493 g of 2-(4-nitrophenyl)-1-formylhydrazine.

Melting point: 184° to 186° C.

(2) 2-(4-Aminophenyl)-1-formylhydrazine

In 1,600 ml of ethanol, 30 g of 2-(4-nitrophenyl)-1-formylhydrazine was catalytically reduced at room temperature, using palladium-carbon as a catalyst. The reaction mixture was filtered and the filtrate was evaporated to dryness, whereby 20.5 g of white solid 2-(4-aminophenyl)-1-formylhydrazine was obtained.

Melting point: 123° to 125° C.

(3) 2-(3-Nitrophenyl)-1-formylhydrazine

By reacting 3-nitrophenylhydrazine as in the same manner as in (1) above, 430 g of 2-(3-nitrophenyl)-1-formylhydrazine was obtained.

Melting point: 168° to 169° C.

(4) 2-(3-Aminophenyl)-1-formylhydrazine

By reacting 2-(3-nitrophenyl)-1-formylhydrazine in the same manner as in (2) above, 21.0 g of 2-(3-aminophenyl)-1-formylhydrazine was obtained.

Melting point: 108° to 113° C.

(5) 1-Benzoyl-2-(4-nitrophenyl)hydrazine 30 g of 4-nitrophenylhydrazine and 45 g of benzoic acid anhydride were dissolved in 200 ml of benzene and the mixture was refluxed by heating for 3 hours. The reaction solution was poured into ice water and the precipitant formed was recovered by filtration, washed with ethanol, and dried, to provide 40 g of 1-Benzoyl-2-(4-nitrophenyl)hydrazine.

Melting point: 194° to 196° C.

(6) 2-(4-aminophenyl)-1-benzoylhydrazine

By catalytically reducing 1-Benzoyl-(2-4-nitrophenyl)-hydrazine in the same manner as in (2) above, 22 g of 2-(4-aminophenyl)-1-benzoylhydrazine was obtained.

Melting point: 135° to 137° C.

II. Synthesis of the Compounds of the Present Invention

(7) Synthesis of Compound 1

23 g of 2-(4-aminophenyl)-1-formylhydrazine was dissolved in a mixture of 75 ml of dimethylformamide and 75 ml of acetonitrile, and, while stirring the solution at a temperature of from −5° C. to −10° C., 18.1 g of phenyl isocyanate dissolved in 75 ml of acetonitrile was added dropwise to the solution. Then, after further continuing the reaction for 2 hours at the same temperature, the crystals formed were recovered by filtration. Crude crystals were dissolved in 300 ml of dimethylformamide and the solution was filtered. 1.5 liters of methanol was added to the filtrate, and the crystals formed were recovered by filtration to provide 28.7 g (70% in yield) of the desired product.

Melting point: 221° to 222° C. (decomposed).

(8) Synthesis of Compound 2

9.1 g of 2-(4-aminophenyl)-1-formylhydrazine was dissolved in a mixture of 60 m of dimethylformamide and 30 ml of acetonitrile, and, while stirring the solution at −15° C., 9.2 g of 4-chlorophenyl isocyanate dissolved in 30 ml of acetonitrile was added dropwise to the solution. After further continuing the reaction for 2 hours at temperatures of from −15° C. to −10° C., 200 ml of acetonitrile was added and the crystals formed were recovered by filtration and washed with 200 ml of acetonitrile. The crude crystals were dissolved in 120 m of dimethylformamide and the solution was filtered. 800 m of methanol was added to the filtrate, and the crystals formed were recovered by filtration to provide 14 g (77% yield) of the desired product.

Melting point: 233° to 235° C. (decomposed)

(9) Synthesis of Compound 3

By following an analogous procedure as in producing Compound 2 described above, using 9.1 g of 2-(4-aminophenyl)-1-formylhydrazine and 9.2 g of 2-chlorophenyl isocyanate as starting materials, 15 g (82% yield) fo the desired product was obtained.

Melting point: 221° to 233° C. (decomposed)

(10) Synthesis of Compound 12

30 ml of an acetonitrile solution of 5.9 g of butyl isocyanate was added dropwise to a mixture of 9.1 g of 2-(4-aminophenyl)-1-formylhydrazine, 30 ml of dimethylformamide, and 30 ml of acetonitrile at −15° C. After causing the reaction to proceed for 3 hours at a temperature of −15° C. to −10° C., 200 ml of acetonitrile was added to the reaction mixture, and the crystals formed were recovered by filtration and recrystallized from 350 ml of ethanol to provide 9 g (60% yield) of the desired product.

Melting point: 178° to 180° C. (decomposed)

(11) Synthesis of Compound 17

In a mixture of 25 ml of dimethylformamide and 35 ml of acetonitrile, 4.8 g of 2-(4-aminophenyl)-1-formylhydrazine and 3.8 g of cyclohexyl isocyanate were reacted with each other in an analogous manner as in the case of compound 2 described above, and the product was reprecipitated with 50 ml of dimethylformamide and 300 ml of acetone, whereby 5.7 g (69% yield) of the desired product was obtained.

Melting point 211° to 213° C. (decomposed)

(12) Synthesis of Compound 20

In the mixture of dimethylformamide and acetonitrile used in the above synthetic procedures, 7.9 g of 2-(4-aminophenyl)-1-formylhydrazine and 6.5 g of ethyl isocyanoacetate were reacted with each other in an analogous manner as in the case of Compound 2 described above, and the product was reprecipitated with dimethylformamideacetonitrile, whereby 10.5 g (75% yield) of the desired product was obtained.

Melting point: 191° to 192.5° C. (decomposed).

Other compounds of the present invention can be similarly synthesized according to the methods described above.

In the direct positive photographic light-sensitive material of the present invention, it is preferred that the compound represented by formula (I) be incorporated into an internal latent image type silver halide emulsion layer. However, the compound can also be incorporated into a hydrophilic colloid layer adjacent to an internal latent image type silver halide emulsion layer. Such a layer can be any layer of a light-sensitive layer, an intermediate layer, a filter layer, a protective layer, an antihalation layer, etc., having any function, as long as the fogging agent is not prevented from diffusing into the internal latent image type silver halide emulsion layer.

It is desired that the fogging agent according to the present invention in the layer(s) be present in an amount that results in a suitable maximum density (for example, above 1.70) when the internal latent image type emulsion is developed by a surface developing solution. For practical purposes, the appropriate content can vary over a wide range, depending upon the characteristics of silver halide emulsion, the chemical structure of the fogging agent and the developing conditions. Nevertheless, a range of from about 0.1 mg to 5,000 mg per mol of silver halide in the internal latent image type silver halide emulsion is generally effective, and more preferably is from about 0.5 mg to about 2000 mg per mol of silver halide. Where the fogging agent is incorporated into the hydrophilic colloid layer adjacent to the emulsion layer, it is adequate to incorporate the fogging agent in the above amount, based on consideration of the amount of silver contained in the associated internal latent image type emulsion layer.

Internal latent image type silver halide emulsions are described by Davey et al, U.S. Pat. No. 2,592,250 and are also described in other references. The internal latent image type silver halide emulsion can be clearly defined by the fact that the maximum density achieved in the case of developing it with an "internal type" developing solution is greater than the maximum density achieved in the case of developing it with a "surface type" developing solution. The internal latent image type emulsion which is suitable for the present invention has a maximum density (measured by an ordinary photographic density measurement method), when coated onto a transparent support and exposed to light for a fixed time period of between 0.01 to 1 second and then developed with Developing Solution A indicated below (an internal type developing solution) at 20° C. for 3 minutes, which is greater, by at least 5 times, than the maximum density obtained in the case of developing the silver halide emulsion exposed as described above with Developing Solution B indicated below (a surface type developing solution) at 20° C. for 4 minutes.

| Developing Solution A: | |
|---|---|
| Hydroquinone | 15 g |
| Monomemethyl-p-aminophenol Sesquisulfate | 15 g |
| Sodium Sulfite | 50 g |
| Potassium Bromide | 10 g |
| Sodium Hydroxide | 25 g |
| Sodium Thiosulfate | 20 g |
| Water to make | 1 l |

-continued

| Developing Solution B: | |
|---|---|
| p-Oxyphenylglycine | 10 g |
| Sodium Carbonate | 100 g |
| Water to make | 1 l |

As internal latent image type emulsions which are suitable for the objects of the present invention, the emulsions described in Japanese Patent Publication No. 34213/77, British Pat. No. 1,027,146, U.S. Pat. Nos. 3,206,313, 3,511,662, 3,447,927, 3,737,313, 3,761,276, 3,271,157, etc., can be employed, in addition to an emulsion as described in U.S. Pat. No. 2,592,250 referred to above. However, the silver emulsions used in the present invention are not limited to these.

In the direct positive photographic light-sensitive material of the present invention, a variety of hydrophilic colloids can be employed as a binder.

As colloids employed for this purpose, hydrophilic colloids conventionally employed in the photographic field can be used, such as gelatin, colloidal albumin, polysaccharides, cellulose derivatives, synthetic resins, for example, polyvinyl compounds, including, e.g., polyvinyl alcohol derivatives, acrylamide polymers, etc. Hydrophobic colloids, e.g., dispersed polymerized vinyl compounds, particularly those that increase dimensional stability of photographic materials, can also be incorporated together with the hydrophilic colloid. Suitable examples of this type of compounds include water-insoluble polymers prepared by polymerizing vinyl monomers such as alkyl acrylates, alkyl methacrylates, acrylic acid, sulfoalkyl acrylates, sulfoalkyl methacrylates, and so forth.

Various compounds can be added to the photographic emulsion described above in order to prevent the reduction in sensitivity or fog formation occurring during the production, storage, or processing of the photographic light-sensitive material. A great many compounds have been known for these purposes, and they include 4-hydroxy-6-methyl-1,3,3a,7-tetrazaindene, 3-methylbenzothiazole, 1-phenyl-5-mercaptotetrazole, various heterocyclic compounds, mercury containing compounds, mercapto compounds, metal salts, etc. Some specific examples of such compounds are mentioned in K. Mees, *The Theory of the Photographic Process,* 3rd ed. 1966 by reference to the papers which first reported such compounds, and in addition, are described in U.S. Pat. Nos. 1,758,576, 2,110,178, 2,131,038, 2,173,628, 2,697,040, 2,304,962, 2,324,123, 2,394,198, 2,444,605-8, 2,566,245, 2,694,716, 2,697,099, 2,708,162, 2,728,663-5, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668 and 3,622,339, British Pat. Nos. 893,428, 403,789, 1,173,609 and 1,200,188, etc.

A variety of photographic supports can be employed in the photographic light-sensitive material of the present invention. The silver halide emulsion can be coated onto one side or both sides of the support.

In the photographic light-sensitive material of the present invention, the photographic silver halide emulsion layers and other hydrophilic colloid layers can be hardened with an appropriate hardening agent. Examples of these hardening agents include vinylsulfonyl compounds, as described in Japanese Patent Application Nos. 151636/76, 151641/76 and 154494/76, hardening agents having active halogen, dioxane derivatives, oxypolysaccharides such as oxy starch, and so forth.

The photographic silver halide emulsion layer can contain other additives, particularly those useful for photographic emulsions, e.g., lubricants, sensitizers, light absorbing dyes, plasticizers, etc.

In addition, in the present invention compounds which release iodine ions (such as potassium iodide) can be incorporated into the silver halide emulsion in order to increase a sensitivity and promote a development and, furthermore, the desired image can be obtained using a developing solution containing iodine ions.

The photographic light-sensitive material of the present invention may contain a water-soluble dye in the hydrophilic colloid layer as a filter dye or for other various purposes like prevention of irradiation or antihalation. Such dyes include oxonol dyes, hemioxonol dyes, styryl dyes, merocyanine dyes, cyanine dyes, and azo dyes. Of these, oxonol dyes, hemioxonol dyes, and merocyanine dyes are useful.

In the photographic light-sensitive material of the present invention, when the hydrophilic colloid layer contains a dye or an ultraviolet ray absorbing agent, etc., these compounds may be mordanted with a cationic polymer, etc. For instance, polymers described in British Pat. No. 685,475, U.S. Pat. Nos. 2,675,316, 2,839,401, 2,882,156, 3,048,487, 3,184,309 and 3,445,231, West German Patent Application (OLS) No. 1,914,362, Japanese Patent Application (OPI) Nos. 47624/75 and 71332/75, etc. can be used.

The photographic light-sensitive material of the present invention can contain surface active agents for a variety of purposes. Depending upon purpose, any one of nonionic, ionic and amphoteric surface active agents can be employed, which are exemplified by, e.g., polyoxyalkylene derivatives, amphoteric amino acids (including sulfobetaines), etc. Examples of such surface active agents are described in U.S. Pat. Nos. 2,600,831, 2,271,622, 2,271,623, 2,275,727, 2,787,604, 2,816,920 and 2,739,391, Belgian Pat. No. 652,862, etc.

In the photographic light-sensitive material of the present invention, the photographic emulsion can be spectrally sensitized with sensitizing dyes to blue light of relatively long wavelengths, to green light, to red light, to infrared light. As sensitizing dyes, cyanine dyes, merocyanine dyes, complex cyanine dyes, complex merocyanine dyes, holopolar cyanine dyes, styryl dyes, hemicyanine dyes, oxonol dyes, hemioxonol dyes, etc., can be employed.

Useful sensitizing dyes which can be employed in accordance with the present invention are described, for example, in U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632 and 2,503,776, Japanese Patent Application (OPI) No. 76525/73, Belgian Pat. No. 691,807, etc.

The sensitizing dyes employed in the present invention are used in a concentration almost equivalent to that used in ordinary negative silver halide emulsion. In particular, it is advantageous that the sensitizing dyes be employed in a dye concentration to a degree that does not substantially cause desensitization in the region of intrinsic sensitivity of the silver halide emulsion. It is preferred that the sensitizing dyes be employed in a concentration of from about $1.0\times10^{-5}$ to about $5\times10^{-4}$ mol per mol of silver halide, and particularly in a concentration of from about $4\times10^{-5}$ to $2\times10^{-4}$ mol per mol of silver halide.

Color image-forming couplers can be incorporated into the photographic light-sensitive material of the present invention. Alternatively, the photographic light-sensitive material can also be developed with a developing solution containing a color image-forming coupler. In order to incorporate a color forming agent into the silver halide emulsion used in the present invention, known methods can be employed. For example, methods as described in U.S. Pat. Nos. 1,055,155, 1,102,028, 2,186,849, 2,322,027 and 2,801,171 can be employed. In the present invention, developing agents, e.g., polyhydroxybenzenes, aminophenols, 3-pyrazolidones, etc., can also be incorporated in the emulsion or the photographic light-sensitive material. Also, the photographic emulsion can be unhardened, or can also contain tanning developing agents such as hydroquinone, catechol, etc.

The photographic emulsion used in the present invention can also be utilized for obtaining desired transfer images on an image-receiving layer after appropriate development processing, in combination with a dye image-providing material for diffusion transfer capable of releasing diffusible dyes in response to development of silver halide. As such a dye image-providing material for diffusion transfer, a number of compounds are known, and such as the compounds described, for example, in U.S. Pat. Nos. 3,227,551, 3,227,554, 3,443,939, 3,443,940, 3,658,524, 3,698,897, 3,725,062, 3,728,113, 3,751,406, 3,929,760, 3,931,144, 3,932,381, 3,928,312, 4,013,633, 3,932,380, 3,954,476, 3,942,987, and 4,013,635, Published U.S. Patent Application B 351,673, British Pat. Nos. 840,731, 904,364 and 1,038,331, West German Patent Application (OLS) Nos. 1,930,215, 2,214,381, 2,228,361, 2,317,134 and 2,402,900, French Pat. No. 2,284,140, Japanese Patent Application (OPI) Nos. 113624/76 (corresponding to U.S. Pat. No. 4,055,428), Japanese Patent Application Nos. 104343/76, 64533/77 and 58318/77, etc. can be employed. Of these, it is preferred that dye image-providing materials of types which are at first non-diffusible, and, after the oxidation-reduction reaction with the oxidation product of the developing agent, cleave to release diffusible dyes (hereafter referred to as DRR (standing for "dye releasing redox") compounds) be employed.

In particular, preferred compounds for use in combination with the fogging agent according to the present invention are DRR compounds having an o-hydroxyarylsulfamoyl group, as described in Japanese Patent Application (OPI) No. 113624/76, and DRR compounds having a redox moiety as described in Japanese Patent Application No. 64533/77.

Specific examples of DRR compounds include, in addition to those as described in the above-described patent specifications, 1-hydroxy-2-tetramethylenesulfamoyl-4-[3'-methyl-4'-(2''-hydroxy-4''-methyl-5''-hexadecyloxyphenylsulfamoyl)-phenylazo]naphthalene as a magneta dye image forming substance, 1-phenyl-3-cyano-4-{3'-[2''-hydroxy-4''-methyl-5''-2''', 4'''-di-t-pentylphenoxyacetamino)phenylsulfamoyl]phenylazo}-5-pyrazolone as a yellow dye image forming substance, etc.

To an emulsion layer or a protective layer of the direct positive photographic light-sensitive material of the present invention, there may be added a matting agent and/or a lubricant, etc. Preferred specific examples of the matting agent employed include organic compounds, for example, water dispersible vinyl polymers such as polymethyl methacrylate having an appropriate particle size (particularly from 0.3 to 5 microns), etc. or inorganic compounds, for example, silver halide, strontium barium sulfate, etc. The lubricant is useful for preventing blocking troubles same as with a matting agent, and in addition, it is particularly effective for the improvement in friction properties with respect to the adaptability of cinematographic films to a camera during photographing and to a projector during projection. Preferred specific examples of the lubricant employed include liquid paraffin, waxes such as esters of higher fatty acids, polyfluorinated hydrocarbons or derivatives thereof, silicones such as polyalkylpolysiloxanes, polyarylpolysiloxanes, polyalkyarylpolysiloxanes or alkyleneoxide addition derivatives thereof, etc.

The photographic light-sensitive material of the present invention can contain various auxiliary layers, such as a protective layer, an interlayer, a filter layer, an anti-halation layer, and the like.

For developing the photographic light-sensitive material for the present invention, a variety of known developing agents can be employed. That is, polyhydroxybenzenes, e.g., hydroquinone, 2-chlorohydroquinone, 2-methylhydroquinone, catechol, pyrogallol, etc.; aminophenols, e.g., p-aminophenol, N-methyl-p-aminophenol, 2,4-diaminophenol, etc.; 3-pyrazolidones, e.g., 1-phenyl-3-pyrazolidones, 4,4-dimethyl-1-phenyl-3-pyrazolidone, 5,5-dimethyl-1-phenyl-3-pyrazolidone, etc.; ascorbic acids, and the like can be employed singly or as a combination thereof. In addition, to obtain dye images in the presence of dye-forming couplers, aromatic primary amine developing agents, preferably p-phenylenediamine type developing agents, can be used. Specific examples thereof include 4-amino-3-methyl-N,N-diethylaniline hydrochloride, N,N-diethyl-p-phenylenediamine, 3-methyl-4-amino-N-ethyl-N-β-(methanesulfonamido)ethylaniline, 3-methyl-4-amino-N-ethyl-N-(β-sulfoethyl)aniline, 3-ethoxy-4-amino-N-ethyl-N-(β-sulfoethyl)aniline, 4-amino-N-ethyl-N-(β-hydroxyethyl)aniline. Such developing agents can be incorporated into alkaline processing compositions (which may take the form of a processing element), or can also be incorporated into appropriate layers of the light-sensitive element.

In the case of using a DRR compound in the present invention, any silver halide developing agent can be employed, as long as the agent is able to cross-oxidize the DRR compounds.

The developing solution can contain, as a preservative, sodium sulfite, potassium sulfite, ascorbic acid, reductones (e.g., piperidinohexose reductone), etc.

The photographic light-sensitive material of the present invention can provide direct positive images by developing the material using a surface developing solution. The surface developing solution induces the development process substantially with latent images or fogging nuclei present on the surface of silver halide grains. Though it is preferred not to contain any silver halide dissolving agent in the developing solution, a small amount of the silver halide dissolving agent (e.g., sulfites) can be contained in the developing solution as long as internal latent images do not substantially contribute to development until the development due to the surface development centers of the silver halide grains is completed.

The developing solution can contain, as an alkali agent and a buffering agent, sodium hydroxide, potassium hydroxide, sodium carbonate, potassium carbonate, trisodium phosphate, sodium metaborate, etc. The amount of these agents is selected so as to result in a pH of the developing solution of from 10 to 13, and preferably a pH of from 11 to 12.5.

The developing solution can also contain color development accelerators such as benzyl alcohol or the like. Further, it is advantageous that the developing solution contains, in order to lessen the minimum density of direct positive images, compounds which are usually employed as anti-fogging agents, for example, benzimidazoles, e.g., 5-nitrobenzimidazole; benzotriazoles, e.g., benzotriazole, 5-methylbenzotriazole, etc.

The photographic light-sensitive material of the present invention can also be processed with a viscous developing solution.

Such a viscous developing solution is a liquid state composition in which processing components necessary for development of silver halide emulsion and for formation of diffusion transfer dye images are contained; a major component of the solvent is water, and, in addition thereto, hydrophilic solvents such as methanol, methyl Cellosolve, etc., are contained therein in some cases. The processing composition contains an alkali in an amount sufficient to maintain a pH necessary for developing the emulsion layer(s) and to neutralize acids (e.g., hydrohalogenic acids such as hydrobromic acid, carboxylic acids such as acetic acid, etc.) formed during various processings for development and formation of dye images. As alkalis, alkali metal or alkaline earth metal salts may be employed, or amines such as lithium hydroxide, sodium hydroxide, potassium hydroxide, calcium hydroxide dispersion, hydroxylated tetramethyl ammonium, sodium carbonate, trisodium phosphate, diethyl amine, and so forth. It is desired that alkali hydroxides be incorporated in the developing solution in such an amount as to result in a pH, preferably, of about 10 to 14 at room temperature, and preferably a pH of 11 to 14. More preferably, the processing composition also contains hydrophilic polymers of high molecular weight, such as polyvinyl alcohol, hydroxyethyl cellulose, sodium carboxymethyl cellulose. It is desired that these polymers be employed so as to impart viscosity above 1 poise at room temperature, and preferably several hundred (500 to 600) to 1,000 poise, to the processing composition.

Furthermore, it is advantageous particularly in the case of a mono sheet film unit that the processing composition contain light absorbing agents such as $TiO_2$, carbon black, pH-indicating dyes for preventing the silver halide emulsion from fogging due to outside light during or after processing, or desensitizers as described in U.S. Pat. No. 3,579,333. In addition, developing inhibitors such as benzotriazole can be incorporated into the processing composition.

It is preferred that the above-described processing composition be employed in a rupturable container as described in U.S. Pat. Nos. 2,543,181, 2,643,886, 2,653,732, 2,723,051, 3,056,491, 3,056,492, 3,152,515, etc.

The present invention will be explained in greater detail by reference to the following examples below. However, the present invention should not be construed as being limited thereto.

EXAMPLE 1

According to the method for preparation of Emulsion A in Example 1 of Japanese Patent Publication No. 34213/77 (U.S. Pat. No. 3,761,276), an internal latent image type direct positive emulsion comprising octahedral silver bromide grains having an average side length of 0.8 microns was prepared. The surfaces of the silver bromide grains of this emulsion were chemically sensitized with sodium thiosulfate. The emulsion was divided into 6 portions, and to each portion, a fogging agent was added, as shown in Table 1 below, and coated on a polyethylene terephthalate support, with the silver coated in an amount of 3,000 mg/m$^2$. On this emulsion layer, a gelatin protective layer was further coated, to prepare Samples 1 to 6.

Samples 1 to 6 were exposed through a stepwedge with a tungsten lamp having a color temperature of 2854° K. and 1 KW for 1 second and developed at 35° C. for 1 minutes using a developing solution which was selected from Developing Solutions I, II, and III as described below to provide the optimum results with respect to each sample, and was then stopped, fixed, and washed with water in a conventional manner.

| | Developing Solution I | Developing Solution II | Developing Solution III |
|---|---|---|---|
| Sodium Sulfite (anhydrous) | 30 g | 30 g | 30 g |
| Hydroquinone | 10 g | 10 g | 10 g |
| Sodium Metaborate | 30 g | 30 g | — |
| Trisodium Phosphate (12 hydrate) | — | — | 80 g |
| Pyrazon | 0.75 g | 0.75 g | 0.75 g |
| Potassium Hydroxide | 10 g | 3 g | — |
| Sodium Hydroxide | — | — | 10 g |
| 5-Methylbenzotriazole | 20 mg | 20 mg | 20 mg |
| Water to make | 1 liter | 1 liter | 1 liter |
| pH | 11.9 | 10.4 | 13.0 |

The pH of each of Developing Solution I, II and III was chosen such a value as to provide the lowest $D_{min}$ and the highest $D_{max}$ when a photographic light-sensitive material containing the specific fogging agent was developed at 35° C. for 1 minute.

Photographic light-sensitive materials in which an amount of a fogging agent added was varied were exposed and developed in the same manner as described above. From the results thus obtained, the smallest amount of the fogging agent added sufficient to result in $D_{max}$ of 1.70 or $D_{min}$ of 0.13 was determined. The amount added, $D_{max}$, and $D_{min}$ in such cases are set forth in Table 1 below. Also, for cases in which the fogging agent was excessively added, the ratio of the amount excessively added to the minimum amount added, $D_{max}$, and $D_{min}$ therefor are shown in Table 1.

TABLE 1

| Sample | Fogging Agent | Developing Solution | Minimum Amount Added: Amount Added | Minimum Amount Added: $D_{max}$ | Minimum Amount Added: $D_{min}$ | Excess Amount Added: Addition Ratio to Minimum Amount | Excess Amount Added: $D_{max}$ | Excess Amount Added: $D_{min}$ |
|---|---|---|---|---|---|---|---|---|
| 1 | Compound 1 (Present Invention) | I | 100 mg/mol/Ag | 1.70 | 0.08 | 8.0 | 1.90 | 0.10 |
| 2 | Compound 6 (Present Invention) | I | 100 mg/mol/Ag | 1.70 | 0.08 | 8.0 | 1.82 | 0.10 |
| 3 | Compound 23 (Present Invention) | I | 45 mg/mol/Ag | 1.70 | 0.08 | 5.0 | 1.75 | 0.08 |
| 4 | Compound A (Comparison) | I | 27 mg/mol/Ag | 1.70 | 0.08 | 2.0 | 1.93 | 0.95 |
| 5 | Compound B (Comparison) | III | 10 mg/mol/Ag | 0.70 | 0.13 | 2.0 | 0.90 | 0.22 |
| 6 | Compound C (Comparison) | II | 130 mg/mol/Ag | 1.70 | 0.04 | 2.0 | 1.87 | 0.20 |

From the results shown in Table 1 it is apparent that $D_{min}$ increases to over an acceptable range due to even a slight increase in the amount added Compounds A, B and C. On the other hand, in case of Compounds 1, 6 and 23, the $D_{min}$ and the $D_{max}$ were affected only to a small extent even when the amount added was greatly increased. It will thus be understood that in the photographic light-sensitive materials of the present invention the variation of reversal characteristics due to the change in an amount of the fogging agent added is very small and the result of good reproducibility can always obtained.

Comparison Compounds A, B and C employed above have the following structural formulae, respectively.

Compound A

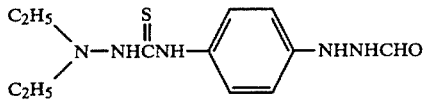

Compound B

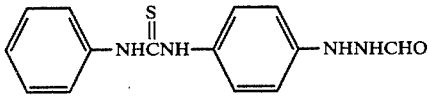

(Fogging agent described in U.S. Pat. No. 4,030,925)

Compound C

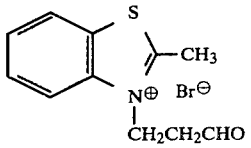

(Fogging agent described in U.S. Pat. No. 3,759,901)

EXAMPLE 2

The fogging agents as shown in Table 2 below were added to an internal latent image type direct positive emulsion as described in Example 1, and thus Samples 7 to 16 were prepared in the same manner as described in Example 1. One portion of each of Samples 7–16 were stored at 40° C. and a relative humidity (RH) of 80% for 2 days, then exposed through a step wedge with a tungsten lamp having the color temperature of 2854° K. and 1 KW for 1 minute, and developed at 35° C. for 1 minute using Developing Solution I, II, or III, as shown in Table 2. On the other hand, other formations of Samples 7 to 16 were allowed to stand at room temperature (25° C.) and at 50% relative humidity, then exposed under the same conditions described above and developed simultaneously in the same developing solution with the above described samples which had been stored at 40° C. and 80% RH. The $D_{max}$ obtained from the sample portions stored at 40° C. and 80% RH is designated $D_1$, and the $D_{max}$ obtained from the sample allowed to stand at room temperature and 50% RH is designated Do, and the relative changes in $D_{max}$ due to the storage under the conditions of high temperature and high humidity, which is determined by the formula $(D_1-D_0)/D_0$ (%) are shown in Table 2 below.

TABLE 2

| Sample | Fogging Agent | Amount Added (mg/mol Ag) | Developing Solution | $D_0$ | $D_1$ | $(D_1 - D_0)/D_0$ (%) |
|---|---|---|---|---|---|---|
| 7 | Compound 1 (Present Invention) | 400 | I | 1.75 | 1.64 | −6.3 |
| 8 | Compound 6 (Present Invention) | 400 | I | 1.78 | 1.72 | −3.3 |
| 9 | Compound 23 (Present Invention) | 530 | I | 1.74 | 1.64 | −5.7 |
| 10 | Compound 27 (Present Invention) | 530 | I | 1.78 | 1.65 | −7.3 |
| 11 | Compound 34 (Present Invention) | 400 | I | 2.06 | 2.06 | 0.0 |
| 12 | Compound 2 (Present Invention) | 400 | I | 2.02 | 1.88 | −6.9 |
| 13 | Compound A (Comparison) | 27 | I | 1.70 | 1.06 | −38 |
| 14 | Compound B (Comparison) | 17 | III | 0.80 | 0.60 | −25 |
| 15 | Compound C (Comparison) | 130 | II | 1.70 | 0.90 | −47 |
| 16 | Compound D (Comparison) | 67 | II | 1.80 | 0.68 | −62 |

It is apparent from the results shown in Table 2 above that the extent of decrease in $D_{max}$ due to the storage under the conditions of high temperature and high humidity in Samples 7 to 12 in remarkably small and the direct positive photographic light-sensitive materials of the present invention are extremely stable in comparison with conventional Samples 13 to 16.

Comparison Compound D employed above has the following structural formula.

Compound D

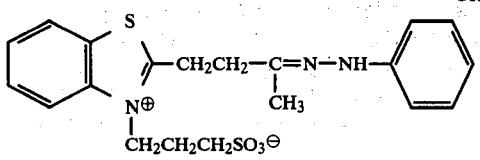

(Fogging Agent described in Japanese Patent Application (OPI) No. 3426/77).

EXAMPLE 3

Equimolar solutions of silver nitrate and of potassium bromide were simultaneously mixed at equal rates at a temperature of 55° C. for 20 minutes using a controlled silver halide precipitation method to prepare a silver bromide emulsion. At the end of the preparation cubic crystals of silver bromide having the side length of 0.1 micron were obtained. To this silver bromide emulsion, there were added sodium thiosulfate in an amount of 40 mg per mol of silver and chloroauric acid (tetrahydrate) in an amount of 40 mg per mol of silver, and the mixture was subjected to chemical ripening by heating at 75° C. for 60 minutes. The silver bromide grains thus chemically ripened were subjected to crystal growth by a method of simultaneously adding a solution of silver nitrate and a solution of potassium bromide, to finally obtain octahedral crystals of silver bromide having the side length of 0.25 microns. The surfaces of these grains were subjected to chemical ripening by adding sodium thiosulfate in an amount of 3.4 mg per mol of silver and auric chloride (tetrahydrate) in an amount of 3.4 mg per mol of silver and heating at 60° C. for 60 minutes. To this emulsion, a fogging agent was added as shown in Table 3 below and coated on a transparent polyethylene terephthalate support at a coated silver amount of 3,000 mg/m$^2$. On this emulsion layer, a gelatin protective layer was coated to prepare Samples 17 to 22. Each sample was exposed in the same manner as described in Example 1 and developed at 35° C. for 1 minute using Developing Solution IV described below in order to evaluate the adaptability to a developing solution having a moderate pH as a developing solution for a direct positive photographic light-sensitive material and the influence by bromine ions accumulated in the developing solution when repeatedly employed, and then stopped, fixed and washed with water in a conventional manner. The results obtained are set forth in Table 3 below.

| Developing Solution IV | |
|---|---|
| Sodium Sulfite | 50 g |
| Potassium Carbonate | 40 g |
| Potassium Bromide | 5 g |
| Pyrazon | 2 g |
| Hydroquinone | 22 g |
| 5-Methylbenzotriazole | 20 mg |
| Water to make | 1 liter |

pH of the solution was adjusted to 11.6 with potassium hydroxide.

TABLE 3

| Sample | Fogging Agent | Amount Added (mg/mol Ag) | $D_{max}$ | $D_{min}$ |
|---|---|---|---|---|
| 17 | Compound 1 (Present Invention) | 400 | 2.84 | 0.06 |
| 18 | Compound 6 (Present Invention) | 600 | 3.00 | 0.06 |
| 19 | Compound 27 (Present Invention) | 600 | 2.65 | 0.08 |
| 20 | Compound A (Comparison) | 67 | 0.18 | 0.22 |
| 21 | Compound B (Comparison) | 200 | 0.04 | 0.12 |
| 22 | Compound E (Comparison) | 600 | 0.04 | 0.14 |

As is apparent from the results shown in Table 3, when a fine grain silver halide emulsion such as that having a side length of 0.25 microns and a developing solution such as Developing Solution IV including 5 g of sodium bromide per liter used in combination therewith, the system containing Compound A, which had shown good reversal characteristics when silver halide grains having the side length of 0.8 microns were used, loses such good reversal characteristics. Also, by using a developing solution having only a moderate pH such as Developing Solution IV (pH: 11.6), the photographic light-sensitive materials containing Compounds B and E, respectively, did not show any reversal characteristics and only negative images having a low density were obtained. On the contrary, Samples 17 to 19, containing fogging agent according to the present invention, show excellent reversal characteristics with Developing Solution IV which has a moderate pH value (11.6) and contains 5 g/liter of sodium bromide. From these results it is clear that the photographic light-sensitive material containing the fogging agent according to the present invention maintains superior reversal characteristics in spite of the variation of the grain size of silver halide emulsion and the accumulation of the bromine ion in a developing solution.

Comparison Compound E employed above has the following structural formula.

Compound E

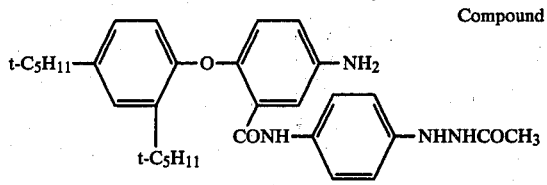

(Fogging agent described in U.S. Pat. No. 2,588,982).

While the invention has been described in detail and with reference to specific embodiments thereof, it will be apparent to one skilled in the art that various changes and modifications can be made therein without departing from the spirit and scope thereof.

What is claimed is:

1. A direct positive silver halide photographic light-sensitive material comprising a support having coated thereon at least one light-sensitive internal latent image silver halide photographic emulsion layer, said silver halide photographic emulsion not being previously fogged, wherein at least one layer of the light-sensitive silver halide photographic emulsion layers and other hydrophilic colloid layers contains a fogging amount of a compound represented by formula (I)

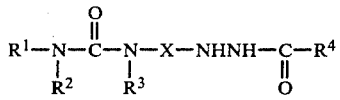

(I)

wherein $R^1$ and $R^2$ can each represent a hydrogen atom, an aliphatic group, an aromatic group, or a heterocyclic group; $R^3$ represents a hydrogen atom or an aliphatic group; $R^4$ represents a hydrogen atom, an aliphatic group, or an aromatic group; and X represents a divalent aryl group.

2. A direct positive silver halide photographic light-sensitive material as in claim 1, wherein the aliphatic groups represented by $R^1$, $R^2$, and $R^4$ are a straight chain or branched chain alkyl group which may be substituted, a cycloalkyl group which may be substituted, an alkenyl group, or an alkynyl group.

3. A direct positive silver halide photographic light-sensitive material as in claim 2, wherein the substituent for the substituted alkyl group or the substituted cycloalkyl group is an alkoxy group, an alkoxycarbonyl group, a carbamoyl group, a hydroxy group, an alkylthio group, an amido group, an acyloxy group, a cyano group, a sulfonyl group, a halogen atom, or an aryl group.

4. A direct positive silver halide photographic light-sensitive material as in claim 1, wherein the aromatic groups represented by $R^1$, $R^2$ and $R^4$ are a phenyl group which may be substituted or a naphthyl group which may be substituted.

5. A direct positive silver halide photographic light-sensitive material as in claim 4, wherein the substituent for the substituted phenyl group or the substituted naphthyl group is an alkyl group, an alkoxy group, an acylhydrazino group, a dialkylamino group, an alkoxycarbonyl group, a cyano group, a carboxy group, a nitro group, an alkylthio group, a hydroxy group, a sulfonyl group, a carbamoyl group, a halogen atom, an acylamino group, a sulfonamido group, or a thiourea group.

6. A direct positive silver halide photographic light-sensitive material as in claim 1, wherein the heterocyclic groups represented by $R^1$ and $R^2$ are a 5-membered or 6-membered single ring, or a condensed ring, having at least one hetero atom selected from oxygen, nitrogen, sulfur, and selenium, and the heterocyclic group may be substituted.

7. A direct positive silver halide photographic light-sensitive material as in claim 6, wherein the substituent for the substituted heterocyclic group is an alkyl group having from 1 to 4 carbon atoms, an alkoxy group having from 1 to 4 carbon atoms, an aryl group having from 6 to 18 carbon atoms, a halogen atom, an alkoxycarbonyl group, a cyano group, or an amido group.

8. A direct positive silver halide photographic light-sensitive material as in claim 1, wherein one of $R^1$ and $R^2$ is a hydrogen atom.

9. A direct positive silver halide photographic light-sensitive material as in claim 1, wherein $R^4$ is a hydrogen atom or a methyl group.

10. A direct positive silver halide photographic light-sensitive material as in claim 1, wherein $R^4$ is a hydrogen atom.

11. A direct positive silver halide photographic light-sensitive material as in claim 1, wherein the aliphatic group represented by $R^3$ is a straight chain or branched chain alkyl group which may be substituted, a cycloalkyl group which may be substituted, an alkenyl group, or an alkynyl group.

12. A direct positive silver halide photographic light-sensitive material as in claim 11, wherein the substituent for the substituted alkyl group or the substituted cycloalkyl group is an alkoxy group, an alkoxycarbonyl group, an aryl group, an amido group or an acyloxy group.

13. A direct positive silver halide photographic light-sensitive material as in claim 1, wherein $R^3$ is a hydrogen atom.

14. A direct positive silver halide photographic light-sensitive material as in claim 1, wherein the divalent aromatic group represented by X is a phenylene group which may be substituted or a naphthylene group which may be substituted.

15. A direct positive silver halide photographic light-sensitive material as in claim 14, wherein the substituent for the substituted phenylene group or the substituted naphthylene group is an alkyl group having from 1 to 20 carbon atoms, an aralkyl group the alkyl moiety of which has from 1 to 3 carbon atoms, an alkoxy group which may be substituted, a mono- or di-substituted amino group which is substituted with one or two alkyl groups which may be substituted, an aliphatic acylamino group, an aromatic acylamino group, an alkylthio group, a hydroxy group, or a halogen atom.

16. A direct positive silver halide photographic light-sensitive material as in claim 1, wherein X is a phenylene group.

17. A direct positive silver halide photographic light-sensitive material as in claim 1, wherein the compound is represented by formula (II)

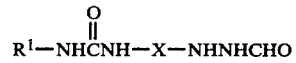

(II)

wherein $R^1$ represents a hydrogen atom, an aliphatic group, an aromatic group or a heterocyclic group; and X represents a divalent aryl group.

18. A direct positive silver halide photographic light-sensitive material as in claim 1, wherein the compound is incorporated in said light-sensitive internal latent image type silver halide emulsion layer.

19. A direct positive silver halide photographic light-sensitive material as in claim 1, wherein the compound is incorporated into a hydrophilic colloid layer adjacent to said light-sensitive internal latent image type silver halide emulsion layer.

20. A direct positive silver halide photographic light-sensitive material as in claim 18, or 19, wherein the amount of the compound is in a range of from 0.1 mg to 5,000 mg per mol of silver halide in the light-sensitive internal latent image type silver halide emulsion.

21. A direct positive silver halide photographic light-sensitive material as in claim 18, or 19, wherein an amount of the compound is in a range of from 0.5 mg to 2000 mg per mol of silver halide in the light-sensitive internal latent image type silver halide emulsion.

22. A direct positive silver halide photographic light-sensitive material as in claim 1, wherein the light-sensitive internal latent image type silver halide photographic emulsion is associated with a color image-forming coupler.

23. A direct positive silver halide photographic light-sensitive material as in claim 1, wherein the light-sensitive internal latent image type silver halide photographic emulsion is associated with a dye-image providing material for diffusion transfer.

24. A direct positive silver halide photographic light-sensitive material as in claim 23, wherein the dye-image providing material is a dye releasing redox compound.

25. A direct positive silver halide photographic light-sensitive material as in claim 23, wherein the dye-image providing material is a dye releasing redox compound having an o-hydroxyarylsulfamoyl group.

26. A method of forming a direct positive image which comprises imagewise exposing a direct positive silver halide photographic light-sensitive material comprising a support having coated thereon at least one light-sensitive internal latent image type silver halide photographic emulsion layer, said silver halide photographic emulsion not being previously fogged wherein at least one layer of the light-sensitive internal latent image type silver halide photographic emulsion layers and other hydrophilic colloid layers contains a fogging amount of a compound represented by formula (I)

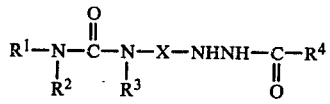

(I)

wherein $R^1$ and $R^2$ can each represent a hydrogen atom, an aliphatic group, an aromatic group, or a heterocyclic group; $R^3$ represents a hydrogen atom or an aliphatic group; $R^4$ represents a hydrogen atom, an aliphatic group, or an aromatic group; and X represents a divalent aryl group, and developing with a developing agent.

* * * * *